United States Patent [19]

Hayes, Jr.

[11] 4,332,137

[45] Jun. 1, 1982

[54] HEAT EXCHANGE APPARATUS AND METHOD HAVING TWO REFRIGERATION CIRCUITS

[75] Inventor: Richmond S. Hayes, Jr., Fayetteville, N.Y.

[73] Assignee: Carrier Corporation, Syracuse, N.Y.

[21] Appl. No.: 87,599

[22] Filed: Oct. 22, 1979

[51] Int. Cl.[3] ..... F25B 41/00

[52] U.S. Cl. ..... 62/81; 62/151; 62/159; 62/510

[58] Field of Search ..... 62/81, 159, 160, 324.1, 62/238 E, 510, 151, 335, 155, 156, 82; 237/2 B

[56] References Cited

U.S. PATENT DOCUMENTS

| | | | |
|---|---|---|---|
| 2,928,256 | 3/1960 | Nonomaque | 62/156 |
| 2,932,178 | 4/1960 | Armstrong | 62/324 |
| 2,978,881 | 4/1961 | Alsing | 62/324 |
| 2,998,710 | 9/1961 | Reese | 62/155 |
| 3,103,794 | 9/1963 | Kyle et al. | 62/160 |
| 3,537,274 | 11/1970 | Tilney | 62/324 |
| 3,638,444 | 2/1972 | Lindahl | 62/81 |
| 3,894,404 | 7/1975 | Stanton | 62/155 |
| 3,978,684 | 9/1976 | Taylor | 62/324 |
| 3,995,809 | 12/1976 | Karlsson | 237/2 B |
| 4,105,064 | 8/1978 | Del Toro et al. | 165/29 |
| 4,149,389 | 4/1979 | Hayes et al. | 62/335 |
| 4,194,368 | 3/1980 | Bahel et al. | 62/335 |

*Primary Examiner*—William E. Wayner
*Assistant Examiner*—Henry Bennett
*Attorney, Agent, or Firm*—J. Raymond Curtin; Robert P. Hayter

[57] ABSTRACT

Apparatus and method for defrosting a dual refrigeration circuit refrigeration system. During defrost one of the refrigeration circuits is operated to supply heat energy to the frosted heat exchanger of the other circuit and the fan circulating heat transfer media through a heat exchanger of each circuit is reversed such that heat transfer fluid is heated by one refrigeration circuit and then used to defrost a heat exchanger of the other circuit.

11 Claims, 3 Drawing Figures

HEAT EXCHANGE APPARATUS AND METHOD HAVING TWO REFRIGERATION CIRCUITS

BACKGROUND OF THE INVENTION

1. Field of the Invention

The present invention relates to a refrigeration circuit for transferring heat energy between two regions. More particularly, the present invention concerns defrost of such a system having multiple refrigeration circuits wherein a single refrigeration circuit is reversed to defrost a heat exchanger of the other circuit.

2. Description of the Prior Art

In a typical vapor compression refrigeration system, various components such as a compressor, condenser, evaporator and expansion device are arranged to transfer heat energy between a fluid in heat transfer relation with the evaporator and a fluid in heat transfer relation with the condenser. In a heat pump system an outdoor coil and an indoor coil are located such that the compressor through a reversing valve may direct hot gaseous refrigerant to either coil acting as a condenser. The other coil then acts as an evaporator such that depending upon the position of the reversing valve, heat energy is either rejected or absorbed in both the indoor coil or the outdoor coil. In the heating mode of operation heat is rejected in the indoor coil acting as a condenser and heat is absorbed at the outdoor coil acting as an evaporator. The reverse is true in the cooling mode of operation wherein the heat is rejected in the outdoor coil acting as a condenser and heat is absorbed in the indoor coil acting as an evaporator.

In heat pump systems using two separate refrigerant circuits each having a compressor it is known to stage the operation of the compressors when the heat pump is either in the cooling mode of operation or the heating mode of operation whereby first one compressor and then the other compressor is energized in sequence as the total load increases. Both compressors are simultaneously operated when the load exceeds the capability of a single circuit. The operation of both the compressors in the heating mode is usually necessary to satisfy heating requirements when the ambient temperature drops below a certain level depending upon the nature of the load and other ambient and temperature conditions.

Additionally, when in the heating mode of operation, frost may form on the outdoor heat exchangers. It is conventional in the art to provide heat energy to an outdoor heat exchanger to melt this ice accumulation. Methods such as reversing the flow of refrigerant in the circuit such that hot gas is provided to the outdoor coil to melt the frost are well known in the art. Additionally, electric resistance heaters and other heat generating devices have been utilized to melt the frost on the heat exchanger. Also known in the art are nonreversed systems wherein through a valving means relatively warm refrigerant flows through the frosted coil to melt the ice formed thereon.

The present invention concerns a refrigeration system having two refrigeration circuits preferably of different capacities, wherein the outdoor coils are located adjacent to each other. In the preferred embodiment hereof the outdoor coils are cylindrical in configuration with one located inside the other. During normal operation a fan is used to circulate heat transfer fluid, typically air, through the heat exchangers in serial arrangement. When a defrost signal is generated, indicating it is appropriate to commence a defrost cycle, one of the two outdoor heat exchangers is operated in the cooling mode by switching the reversing valve such that hot gas is directed into the outdoor heat exchanger. Additionally, the fan for drawing heat transfer fluid through the two outdoor heat exchangers is also reversed such that heat transfer fluid flows first over the outdoor coil which is rejecting heat. The heat transfer fluid absorbs the rejected heat and then travels to the frosted outdoor coil to which this heat is rejected melting the ice formed thereon. Additionally, the systems are sized such that the heat energy withdrawn from the indoor coil and transferred to the outdoor coil in the cooling mode is balanced by the heat energy transferred from the frosted over coil to its corresponding indoor coil such that the enclosure to be heated does not have heat energy withdrawn therefrom to effect defrost of the outdoor coil.

SUMMARY OF THE INVENTION

It is an object of the present invention to provide a refrigeration system having two refrigeration circuits and an improved method of defrost therefor.

It is a further object of the present invention to provide a refrigeration system having two refrigeration circuits each having a compressor of a different size such that the system will provide multiple capacity refrigeration cooling and heating.

It is another object of the present invention to provide a safe, economical and reliable dual circuit refrigeration system.

These and other objects of the present invention are achieved by air heating and cooling apparatus more commonly known in the art as a reverse cycle heat pump including multiple circuit refrigeration system having two compressors, a first heat exchanger for each compressor and a second heat exchanger for each compressor. Reversing valves are additionally provided such that the direction of flow of the refrigerant within each circuit may be altered. During cooling operation either or both compressors may be operated to reject heat from the second heat exchanger and absorb heat in the first heat exchanger. During heating operations either or both the compressors may be operated to reject heat to the first heat exchanger and absorb heat from the second heat exchanger. During heating operation when defrost is necessary a single refrigeration circuit may be reversed such that heat is rejected in one second heat exchanger and transferred to the other second heat exchanger having frost thereon. A fan may be reversed such that the heat transfer fluid transfers heat energy from the second heat exchanger rejecting heat to the second heat exchanger having frost thereon.

DESCRIPTION OF THE PREFERRED EMBODIMENT

The invention as described herein will refer to a dual refrigeration circuit heat pump system. This invention finds applicability in other types of refrigeration systems such as freezers, air conditioning units, ice makers and other apparatus requiring defrost of a heat exchanger. The preferred embodiment has an intertwined indoor heat exchanger serving as the indoor heat exchanger for both systems. It is within the spirit and scope of this invention to have separate indoor heat exchangers in heat transfer relation with each other. This preferred embodiment as disclosed has two outdoor heat exchangers in cylindrical configuration mounted one inside the other. A fan is provided for drawing air either through the heat exchangers serially or discharging air through the heat exchangers serially. It is to be understood that this invention has like applicability to a row split coil having different refrigeration circuits and to coils of configurations other than cylindrical.

Figure 1:
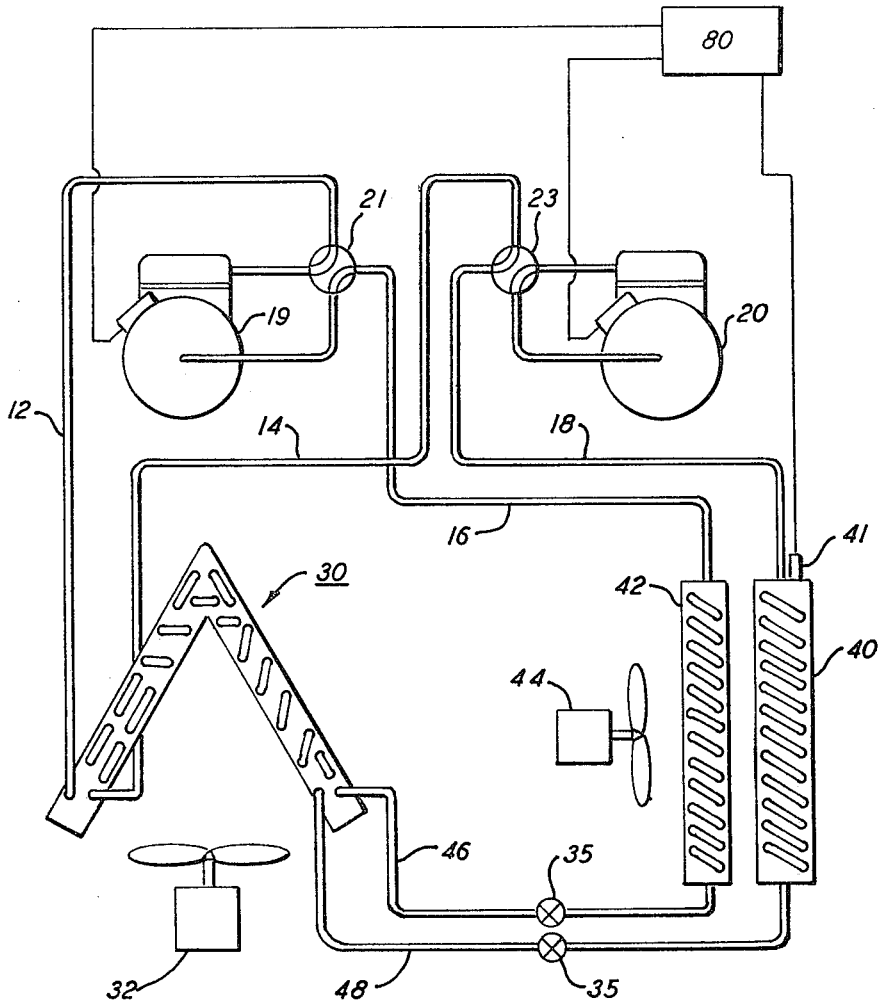
FIG. 1 is a schematic view of the heat pump system having two refrigeration circuits.

Referring now to FIG. 1, there can be seen a heat pump system having compressors 19 and 20. Compressor 19 discharges refrigerant to reversing valve 21 and from there the refrigerant may be conducted through conduit 12 to indoor heat exchanger 30. This refrigerant is then conducted through line 46 through expansion means 35 to outdoor heat exchanger 42. This is the first outdoor heat exchanger and is connected by line 16 back to reversing valve 21 back to compressor 19.

The second refrigeration circuit has compressor 20, reversing valve 23 and line 14 connecting reversing valve 23 to indoor heat exchanger 30. Indoor heat exchanger 30 of the second refrigeration circuit is connected to line 48 through expansion means 35 to the second outdoor heat exchanger 40 which is connected by line 18 back to the reversing valve 23 which is again connected to compressor 20. Controls 80 are shown connected to compressors 19 and 20 and to the second outdoor heat exchanger such that the various compressors may be operated under the appropriate conditions. Additionally the input to this control includes defrost means 41 and controls not shown for operating the indoor fan motor 32, the outdoor fan motor 44 and the reversing valves. The outdoor fan may be operated in two rotational directions such that the flow of air through the first outdoor heat exchanger 42 and second outdoor heat exchanger 40 may be reversed. During cooling operations reversing valves 21 and 23 are arranged such that hot gaseous refrigerant from the compressor is conducted first to the outdoor heat exchangers 40 and 42. This hot gas is condensed to a liquid in the heat exchangers, undergoes a pressure drop in the expansion means and is then conducted to indoor heat exchanger 30 which acts as an evaporator. In the indoor heat exchanger the refrigerant changes state from a liquid to a gas absorbing heat energy from the air circulated by fan 32 such that the air is cooled and returned to the enclosure. The gaseous refrigerant is then conducted back to the compressors through lines 12 and 14 and the appropriate reversing valves to complete the cycle.

During the heating mode of operation reversing valves 21 and 23 are arranged such that hot gaseous refrigerant is discharged from both compressors into indoor heat exchanger 30 acting as a condenser wherein heat is rejected to the enclosure air being circulated thereover by fan 32. The liquid refrigerant then passes through expansion means 35 into the outdoor heat exchangers 40 and 42 acting as evaporators to absorb heat from the ambient air. This refrigerant changes from a liquid to a gas in the outdoor heat exchangers and is then conducted back to the compressors to complete the cycle.

During the heating mode of operation the defrost sensor 41 may detect the need to defrost one or both outdoor heat exchangers. Defrost means 41 may be any suitable device or mechanism for ascertaining a need for defrost or for predicting a need based on a time interval or other method such that defrost of the heat exchanger is accomplished. During defrost the reversing valve 21 of the first refrigeration circuit is placed in the cooling mode such that hot gaseous refrigerant is conducted to first outdoor heat exchanger 42. The first outdoor heat exchanger acts to reject heat to the heat transfer fluid flowing thereover. The fan 44 is reversed such that heat transfer fluid flows first through heat exchanger 42 where it is heated and then to heat exchanger 40 where it rejects heat to the coil melting the ice formed thereon. During normal operation the air flows first through outdoor heat exchanger 40 and then through outdoor heat exchanger 42 such that there is serial flow through both heat exchangers. During defrost operation outdoor fan 44 is reversed such that the serial flow of the heat transfer fluid, normally air, passes first through the first outdoor heat exchanger and then the second outdoor heat exchanger.

It has been discovered that frost accumulation starts on the ambient side of a heat exchanger and progresses inwardly. Consequently, it is the interior heat exchanger which is used to supply heat for defrosting the exterior heat exchanger. By careful selection of the defrost controls and sizing of the respective refrigeration circuits it is believed that frost accumulation on the interior heat exchanger may be held to a minimum or even eliminated. In any event the supplying of hot refrigerant to the first outdoor heat exchanger will melt any frost accumulated thereon such that a system is provided for defrosting both outdoor coils while only reversing one refrigeration circuit.

Typically the two refrigeration circuits are sized such that the first circuit is considerably smaller than the second circuit. The sizing is selected such that depending upon the ambient conditions of the geographical location both systems will have an approximately equal number of yearly operating hours. Under partial load conditions the load on the system is satisfied by operating only one of the refrigeration circuits.

During defrost the first indoor heat exchanger of the first refrigeration circuit is in heat transfer relation with the second indoor heat exchanger of the second refrigeration circuit such that the heat being absorbed in the first refrigeration circuit at the indoor heat exchanger may be supplied from the heat being rejected by the second indoor heat exchanger of the second refrigeration circuit. Consequently, there may be no removal of heat from the enclosure to be conditioned during defrost.

Figure 3:
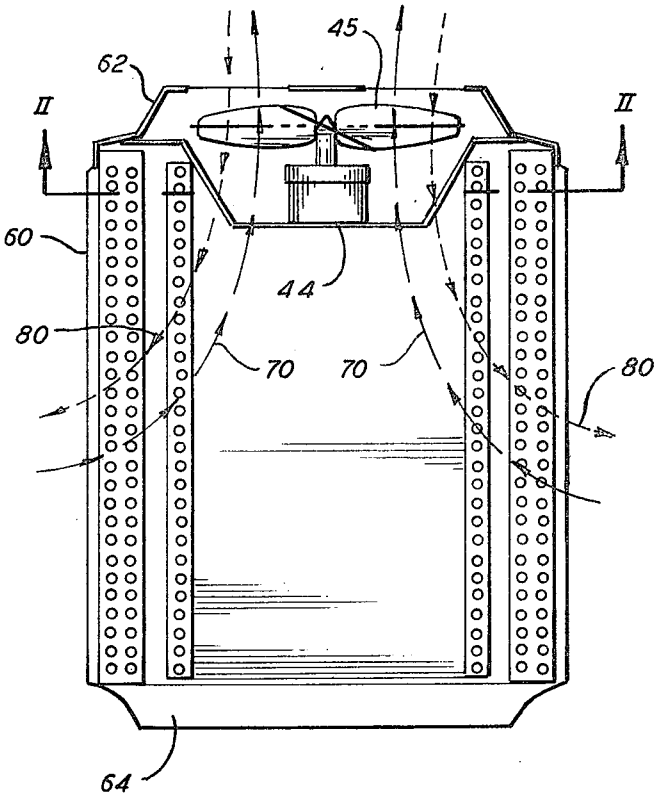
FIG. 3 is a sectional view of the outdoor heat exchange unit of a multiple circuit heat pump system.
Figure 2:
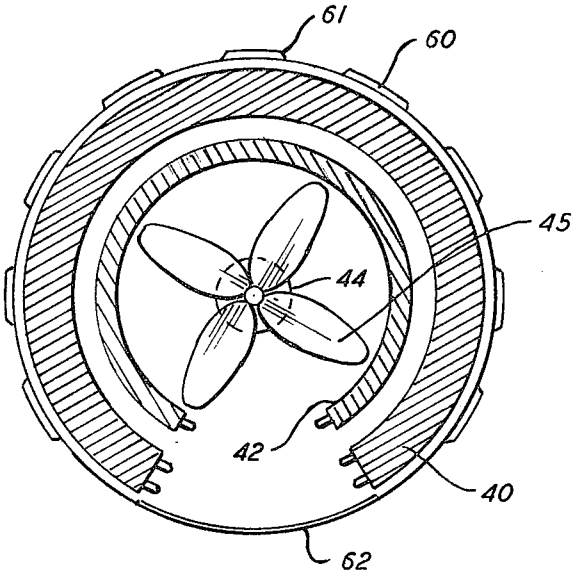
FIG. 2 is a top view of the outdoor heat exchange unit of such heat pump system.

Referring now to FIGS. 2 and 3, a specific embodiment of an outdoor heat exchange unit having first and second outdoor heat exchangers can be seen. The first outdoor heat exchanger 42 is shown mounted within second outdoor heat exchanger 40 such that both are generally cylindrical in configuration and such that the first outdoor heat exchanger 42 has a diameter less than the second outdoor heat exchanger 40. These are shown as two separate heat exchangers, however, it would be equally satisfactory to have a single row split coil. Additionally, as can be seen in FIG. 2, the first outdoor heat exchanger is shown as a single row coil and the second outdoor heat exchanger is shown as a double row coil. This is merely to approximate the relative size of the heat exchanger which may vary depending upon the ambient conditions and geographical location selected. It can be seen in FIGS. 2 and 3 that the overall unit is generally cylindrical in shape, has a grille 60 with grille openings 61 through which air may enter at the sides thereof and has a top cover 62 through which air may be discharged from the unit. Fan 45 is powered by fan motor 44 located at the top of the unit such that air is drawn in from the sides through the second outdoor heat exchanger, through the first outdoor heat exchanger and then discharged out of the top of the unit. When the outdoor fan is reversed air is drawn from the top of the unit and discharged outwardly through the first outdoor coil and then through the second outdoor coil. The flow path as shown by arrow 70 indicates flow of air during normal heating and cooling operations of the unit. Flow path 80 shows the flow of air during defrost with the fan reversed and the first outdoor coil acting as a heat rejecting coil and the second outdoor coil acting as a heat receiving coil such that frost thereon is melted. Access door 62 as shown in FIG. 2 is part of grille 60 such that the repairman may have access to the interior of the unit. Base pan 64 as shown in FIG. 3 acts to support the two coils and grille to provide an integral unit.

The controls for this type heat pump are conventional with the exception that upon the unit being placed in the defrost mode of operation at the same time the reversing valve of the first compressor is energized or switched to the cooling mode of operation the outdoor fan motor is reversed which reverses the direction of air flow. Conventionally the outdoor fan is not energized during defrost. Additionally, in defrost the outdoor fan may be operated at a reduced speed.

While the invention has been described in reference to the preferred embodiment it is to be understood by those skilled in the art that modifications and variations can be effected within the spirit and scope of the invention. It is further to be understood that although the preferred embodiment was described having two outdoor heat exchangers of generally cylindrical configuration it is neither necessary that the two heat exchangers be of that configuration nor that they be two separate heat exchangers rather than a single row split coil.

What is claimed is:

1. An air conditioning system having two refrigeration circuits which comprises:

a first refrigeration circuit having a first compressor, a first outdoor heat exchanger, a second indoor heat exchanger for conditioning air of an enclosure, and means for supplying relatively hot refrigerant to the first outdoor heat exchanger;

a second refrigeration circuit parallel with the first refrigeration circuit having a second compressor, a third outdoor heat exchanger, and a fourth indoor heat exchanger for conditioning air of an enclosure, said third outdoor heat exchanger being located adjacent the first outdoor heat exchanger;

fan means for circulating a heat transfer fluid in heat transfer relation with both the first outdoor heat exchanger and the third outdoor heat exchanger;

defrost means for generating a defrost signal for defrost of the third outdoor heat exchanger; and control means for activating the means for supplying relatively hot refrigerant to the first outdoor heat exchanger and for operating the fan means in response to the defrost signal, said fan means causing the heat transfer fluid to be displaced such that heat energy is transferred from the first outdoor heat exchanger to the third outdoor heat exchanger to melt the frost formed thereon.

2. The apparatus as set forth in claim 1 wherein the fan means includes means for reversing the flow direction of the heat transfer medium in response to a signal from the control means.

3. The apparatus as set forth in claim 1 wherein the first outdoor heat exchanger is located adjacent the third outdoor heat exchanger such that the heat transfer fluid flows serially through both heat exchangers.

4. The apparatus as set forth in claim 1 wherein the third outdoor heat exchanger is generally cylindrical in configuration, the first outdoor heat exchanger is generally cylindrical in configuration and fits within the third outdoor heat exchanger and wherein during nondefrost operation heat transfer fluid flows first through the third outdoor heat exchanger and next through the first outdoor heat exchanger and upon a defrost signal being detected by the control means the fan means is reversed such that the heat transfer fluid flows first through the first outdoor heat exchanger and then through the third outdoor heat exchanger.

5. The apparatus as set forth in claim 1 wherein the capacity of the first refrigeration circuit is sized in comparison to the second refrigeration circuit such that the first circuit may supply sufficient heat energy to defrost the third outdoor heat exchanger while the second refrigeration circuit continues to supply heat energy to the fourth indoor heat exchanger.

6. The apparatus as set forth in claim 1 wherein the second indoor heat exchanger and the fourth indoor heat exchanger are in heat exchanger relation with each other.

7. The apparatus as set forth in claim 6 wherein the second indoor heat exchanger and the fourth indoor heat exchanger comprise a single intertwined heat exchanger coil.

8. A heat pump system having two separate vapor compression refrigeration systems which comprises:

a first compressor a second compressor reversing means connected to the first compressor an indoor heat exchanger connected to both compressors a first outdoor heat exchanger connected to the first compressor a second outdoor heat exchanger connected to the second compressor and located adjacent the first outdoor heat exchanger reversible fan means for circulating air in heat exchange relation with the first and second outdoor heat exchangers defrost means for generating a defrost signal for defrost of the second outdoor heat exchanger control means responsive to the defrost means for reversing the fan means and for switching the reversing means such that heat energy is supplied to the first outdoor coil and air is circulated over the first outdoor heat exchanger absorbing heat energy therefrom, said air being conducted to the second outdoor heat exchanger where a portion of the heat energy is rejected to defrost said second outdoor heat exchanger.

9. The apparatus as set forth in claim 8 wherein the first and second outdoor heat exchangers are both cylindrical in configuration and the first outdoor heat exchanger having a smaller diameter than the second outdoor heat exchanger is located within the second outdoor heat exchanger and the fan means either circulates air through the second outdoor heat exchanger and then the first outdoor heat exchanger or the first outdoor heat exchanger and then the second outdoor heat exchanger.

10. A method of controlling an air conditioning system having multiple refrigeration circuits including an outdoor heat exchanger for each circuit and a fan for circulating air serially through the outdoor heat exchangers, a compressor for each circuit, an indoor heat exchanger for each circuit for conditioning air of an enclosure which comprises the steps of selectively energizing the compressors to transfer heat energy between the outdoor heat exchanger and the indoor heat exchanger of each circuit;

energizing the fan to circulate a heat transfer medium in heat exchange relation with the outdoor heat exchangers, generating a defrost signal for commencing defrost of at least one outdoor heat exchanger, conducting relatively hot refrigerant to at least one of the outdoor heat exchangers upon the generation of a defrost signal, and modifying the step of energizing the fan upon the generation of a defrost signal such that the heat transfer medium flows in heat exchange relation with the outdoor heat exchanger rejecting heat energy, absorbs a portion of said heat energy and then flows into heat exchange relation with the outdoor heat exchanger to be defrosted, the heat transfer medium rejecting heat energy to the outdoor heat exchanger to be defrosted to melt the frost accumulated thereon.

11. The method as set forth in claim 10 wherein the indoor heat exchangers of each circuit are in heat exchange relation with each other and wherein the step of switching includes transferring heat energy from the indoor heat exchanger of the refrigeration circuit having the outdoor heat exchanger which is to be defrosted to the indoor heat exchanger of the refrigeration circuit rejecting heat at the outdoor heat exchanger.

* * * * *